United States Patent [19]

Turk et al.

[11] Patent Number: 4,460,133

[45] Date of Patent: Jul. 17, 1984

[54] WINDING DEVICE

[75] Inventors: Herbert Turk, Remscheid; Herbert Schiminski, Hückeswagen, both of Fed. Rep. of Germany

[73] Assignee: Barmag Barmer Maschinenfabrik AG, Remscheid-Lennep, Fed. Rep. of Germany

[21] Appl. No.: 396,327

[22] Filed: Jul. 8, 1982

[30] Foreign Application Priority Data

Jul. 11, 1981 [DE] Fed. Rep. of Germany ..... 3127551
Jan. 30, 1982 [DE] Fed. Rep. of Germany ..... 3203140

[51] Int. Cl.[3] ..... B65H 54/54; B65H 67/04; B65H 65/00

[52] U.S. Cl. ..... 242/18 A; 242/18 PW; 242/19; 242/46.4

[58] Field of Search ..... 242/18 R, 18 A, 18 PW, 242/19, 25 R, 25 A, 46.4

[56] References Cited

U.S. PATENT DOCUMENTS

| | | | |
|---|---|---|---|
| 3,767,129 | 10/1973 | Sobel | 242/18 PW X |
| 3,801,038 | 4/1974 | Wust | 242/19 |
| 3,809,326 | 5/1974 | Wust | 242/19 |
| 3,815,836 | 6/1974 | Munnekehoff et al. | 242/46.4 |
| 3,856,222 | 12/1974 | Wust | 242/18 A |
| 4,002,307 | 1/1977 | Turk et al. | 242/18 A |
| 4,014,476 | 3/1977 | Turk et al. | 242/19 |
| 4,106,711 | 8/1978 | Oswald et al. | 242/19 |
| 4,155,512 | 5/1979 | Bauch et al. | 242/18 A X |
| 4,166,587 | 9/1979 | Miller | 242/18 A |
| 4,175,712 | 11/1979 | Schippers et al. | 242/46.4 |
| 4,186,890 | 2/1980 | Miller | 242/18 A |
| 4,223,849 | 9/1980 | Schippers et al. | 242/46.4 |
| 4,230,285 | 10/1980 | Lenk et al. | 242/43 R |
| 4,336,912 | 6/1982 | Greb | 242/19 |

FOREIGN PATENT DOCUMENTS

| | | |
|---|---|---|
| 2208558 | 2/1972 | Fed. Rep. of Germany . |
| 2352435 | 4/1975 | Fed. Rep. of Germany . |
| 2540853 | 4/1976 | Fed. Rep. of Germany . |
| 2540854 | 4/1976 | Fed. Rep. of Germany . |
| 2643271 | 3/1978 | Fed. Rep. of Germany . |
| 2248875 | 1/1979 | Fed. Rep. of Germany . |
| 513763 | 11/1971 | Switzerland . |

*Primary Examiner*—Stanley N. Gilreath
*Attorney, Agent, or Firm*—John H. Shurtleff

[57] ABSTRACT

A winding device for winding threads on one or more bobbin tubes releasably held on a rotatable chuck means with improved thread catching and gripping means, preferably in combination with associated thread severing means, in order to make a thread changeover from a completed bobbin to an empty bobbin tube without thread loss and without thread ends or residues being caught and retained on the chuck.

12 Claims, 6 Drawing Figures

WINDING DEVICE

BACKGROUND OF THE INVENTION

The present invention relates to a winding device for the winding of continuous filamentary structures, i.e. threads or yarns, especially freshly spun synthetic filaments or threads composed of synthetic fibers, with means for changing the running thread from a completed bobbin to an empty tube.

Such winding devices are generally known and have been described, for example, in U.S. Pat. No. 4,002,307, with respect to their winding function and the conduction of the thread during a thread changeover from a completed bobbin to an empty tube. In particular, a winding device is shown with a turnable bobbin revolver and an automatic bobbin change for multiple bobbins which are produced successively on a rotatable clamping chuck. The object of such devices is to achieve a loss-free winding of continuously supplied thread to the bobbins at a high winding speed while permitting a quick change or transfer of the thread from a substantially completely wound bobbin to an empty bobbin on a chuck of the bobbin revolver.

In U.S. Pat. No. 4,014,476, there is provided a very similar winding device of this kind for winding threads of higher denier, i.e. technical threads used for coarse denier home textiles, carpet yarn, tire cord, etc., onto multiple bobbin tubes which are coaxially slipped onto or off a clamping chuck with means to release the clamping action when the chuck is in a rest position. Each bobbin tube on the chuck is provided in the region of its thread separating point with radially directed thread cutting blades having axially running cutting edges, and each bobbin tube has a thread-catching notch on its facing end and also a projection or lug on this facing end for the maintenence of a defined spacing or grip between each of the bobbin tubes. In the thread changeover or transfer, the thread caught by the notch on the empty tube is drawn into the gap provided between the bobbin tubes and severed on the cutting edge of the next adjacent cutting blade.

In many ways, the winding function of the above-noted earlier devices have proved successful in actual practice. Nevertheless, the specially required bobbin tubes were found disadvantageous because they are especially subject to wear and damage so that they have only a limited reuse. It was found, for example, that the spacing lugs projecting axially on the end faces of the bobbin tubes or sleeves become detached during transport or after the bobbins are worn down so that upon reuse of the tubes, the desired spacing function no longer can be assured. Moreover, the thread-catching notches in the customary cardboard bobbin tubes are distorted or deformed in such a way that after using the tube a number of times, the catching and retaining of the thread in the notch become more and more uncertain in the winding operations.

Finally, in U.S. Pat. Nos. 4,336,912 and 4,155,512, in order to execute various funcitons in the thread change, constructive measures are provided on the bobbin clamping chucks of the automatic winding devices themselves. Thus, particular elements or means are incorporated into the clamping chuck for catching and holding the thread, for cutting or severing the thread and for maintaining the bobbin spacing, all of which are actuated during the thread change without substantial additional operating procedures. Such arrangements have the advantage that it is possible to use commercially available cardboard bobbin tubes without any catching notches or spacing lugs. On the other hand, it proved to be impossible to preclude thread residues from catching or sticking to the chuck, i.e. an accumulation of looped or entangled waste ends of the thread. The operating personnel therefore must always examine each clamping chuck after it comes to a standstill and also after withdrawing the full bobbin or bobbins in order to at least look for thread residues and to remove these residues from time to time. Such constant inspection makes it difficult to use automatic doffers, which would reduce the number of personnel, since the checking operation and the prevention of troubles caused by thread residues still must be carried out by about the same number of operating personnel required to manually remove full bobbins and supply empty bobbin tubes.

SUMMARY OF THE INVENTION

It is an object of the present invention to redesign and improve the clamping chuck of a winding device in an otherwise conventional winding machine such that it is possible to substantially avoid the sticking or clinging of thread residues and particularly to avoid the formation of thread winders, i.e tangled loops or thread wrappings in the zone of the so-called separation point between bobbin tubes.

It is also an object of the present invention to ensure a firm gripping or holding of the thread end which belongs to the bobbin tube being wound while positively releasing this thread end for doffing or withdrawing the completely wound bobbin.

These and other objects and advantages are accomplished in accordance with the invention by an arrangement of special axially slidable thread gripping means constructed as paired catch rings carried on the clamping chucks in the region of the separation point of each bobbin tube. Special thread severing means, e.g. cutting blades, are also provided to cut the initially gripped thread as it is introduced onto an empty bobbin tube. In a preferred embodiment of the invention, both the catch rings and the thread severing or cutting blades lie in the end zone of each bobbin tube being held on the clamping chuck.

The individual catch rings for gripping each thread are preferably arranged inside the mantle or outer sleeve of the clamping chuck, e.g. as a pair of side-by-side annular rings with their opposing end faces pressed resiliently against one another by means of any suitable forcing or tensioning means, preferably by using spring elements such as helical compression springs. In this arrangement, both catching rings or else only one of the two catching rings can be arranged so as to be axially movable on the chucking spindle. The springs which press at one end against a movable catch ring or its movable portion, and at the other end abut against an axially immovable part of the clamping chuck, for example the chucking spindle shaft the mantle or other ring portions fastened to the spindle shaft. A thread which is caught, for example, on the empty tube is then drawn into the gap or slit formed between the adjacent opposing end face surfaces of the catch rings and held tightly until it is severed on one of the cutting blades. At this point in the changeover operation, the thread end running to the full bobbin is drawn out from between the catch rings resiliently pressed against one another by springs, while the thread end belonging to the bobbin to be wound is held fast by the catch rings and is released only when the clamping chuck is acted upon by a fluid pressure medium, e.g. compressed air, after the completion of this bobbin, thereby relaxing and releasing the held thread end of the complete bobbin at about the same time that the clamping chuck is released.

For this purpose, it is possible to adopt the clamping chuck constructed according to the general principles disclosed in U.S. Pat. No. 4,223,849, wherein the catch rings of the present invention can be mechanically connected with a cage member which is axially slidable in the chuck by means of an axially movable annular piston so that at least one catch ring is also moved axially against the force of circumferentially distributed spring members in order to release the thread gripping or holding force exerted between the adjacent opposing end faces of the catch rings. When the pressure on the annular piston is relieved, the thread gripping connection is reestablished by the resilient action of the springs.

Advantageously, the bobbin tubes can have a thread catching notch at one end adjacent to or in a region directly over the catch rings. This thread catching notch essentially acts to deflect and guide the inflowing thread only very briefly and merely offers a sort of "climbing aid" to locate or position the thread into the slit or gap between the catch rings. The demands on this notch are therefore much lower than in the case of the prior winding devices described above where the notch must also securely grip the thread. With the present invention, the production of the thread catching and guiding notch on the tube is considerably cheaper and, at the same time, only minimal demands are placed on this notch so that each bobbin tube can be reused many times without any appreciable wear or damage to the notch.

Although the particular improvements of this invention can be used to advantage on winding machines in which each winding position or spooling unit (pirning head) has only a single bobbin pin or spindle arranged at a fixed position, usually such that only one bobbin at a time can be wound, the advantages of these improvements become especially important in those winding machines where each winding position is equipped with a bobbin revolver on which at least two bobbin spindles are turnably carried and in which the thread is automatically changed without loss during each bobbin change. Each bobbin spindle on the revolver can have several clamping chucks arranged in axial succession, one after another, so that several bobbins can be produced simultaneously on a single bobbin spindle.

The improvements of the invention are also advantageously used in conjunction with a clamping chuck in which the chucking spindle as a shaft or mandrel is concentrically surrounded by a mantle or shell which has radial recesses permitting the radial movement of circumferentially distributed clamping elements for the clamping of preferably two or more bobbin tubes. When the clamping elements are released by means of a pneumatically operated annular piston so as to free the bobbin tube or tubes, a mechanical connection or linkage between the catch rings and the annular piston also causes the previously gripped thread end to be set free. Both the clamping chucks and also the thread catching and gripping means are resiliently pushed or urged into their operating position by suitable force transmitting means, preferably by springs which exert the required resilient force.

Suitable clamping chuck constructions and arrangements which are useful within the scope of this invention are shown, for example, in U.S. Pat. Nos. 3,815,836, 4,175,712 and 4,223,849, the disclosures of which are incorporated herein by reference as fully as if set forth in their entirety. However, other chuck constructions and arrangements are also useful, e.g. those in which an axial movement is converted into a radial clamping force, as, for example, clamping chucks in which a flexible tube, ring, collar or the like composed of an elastic material, e.g. rubber, lies with one diameter on the clamping chuck while extending in circumferential direction and is forced by axial upsetting into a radial yielding of the elastic material into a larger diameter and, therefore, into a radially directed clamping movement.

The invention is explained in greater detail as follows with the aid of the accompanying drawings illustrating the preferred embodiments. The objects and advantages of the invention may be achieved with a large number of different thread winding devices so that the illustrated embodiments are given only by way of example, the scope of the invention being defined by the individual claims appended hereto.

THE DRAWINGS

Figure 5:
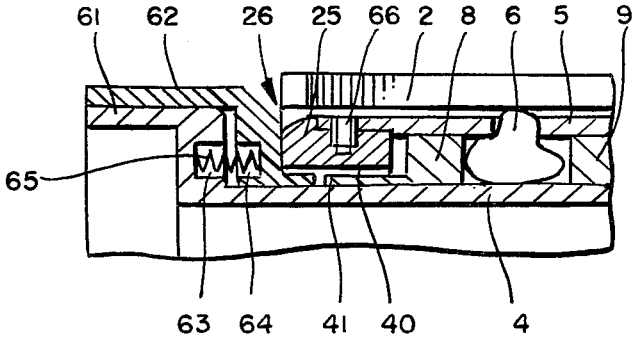
Figure 6:
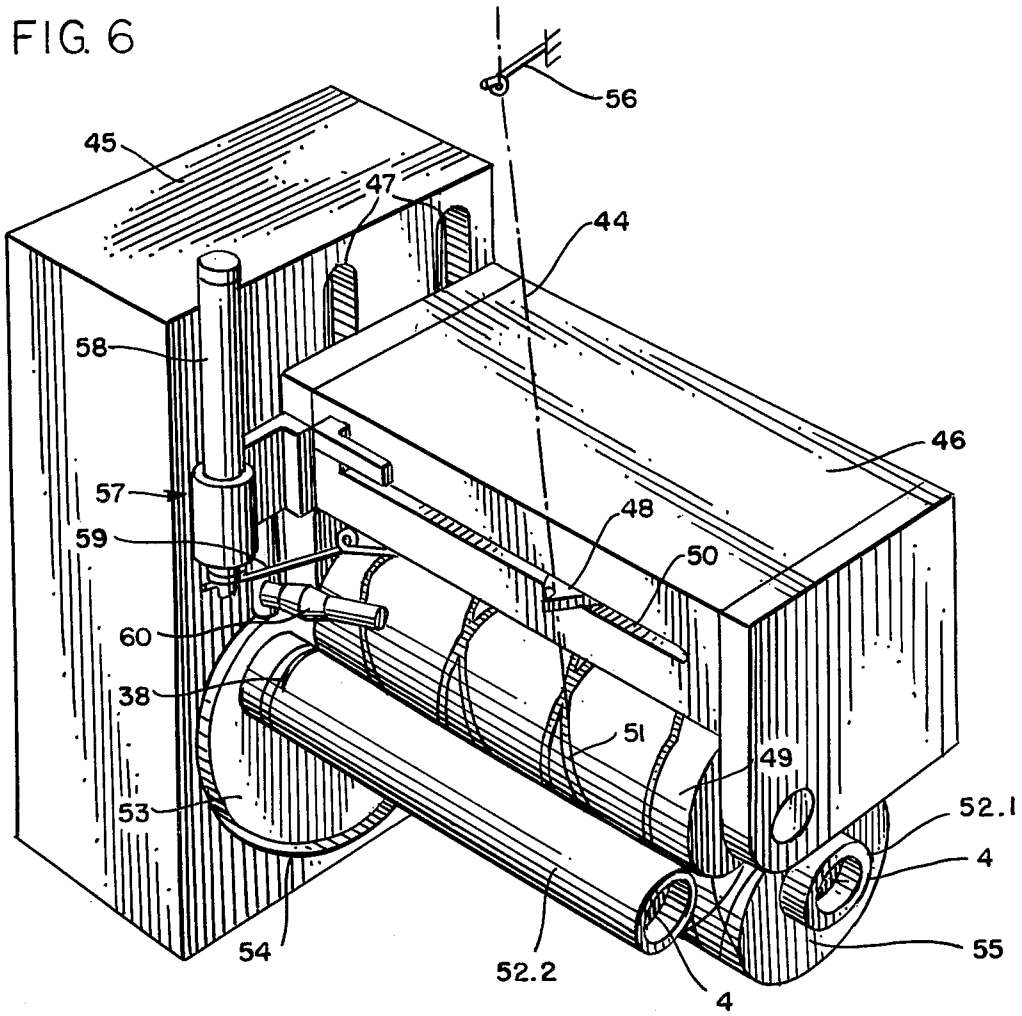

FIG. 5 is a sectional view of a cut-out portion of the clamping chuck on its spindle end which faces the machine stand or frame; and FIG. 6 is a perspective view of a complete spooling head or winding unit on which the improvements according to the invention are incorporated, especially so as to illustrate the use of a bobbin revolver and the related thread guide and positioning means associated therewith.

DESCRIPTION OF THE PREFERRED EMBODIMENTS

Figure 1:
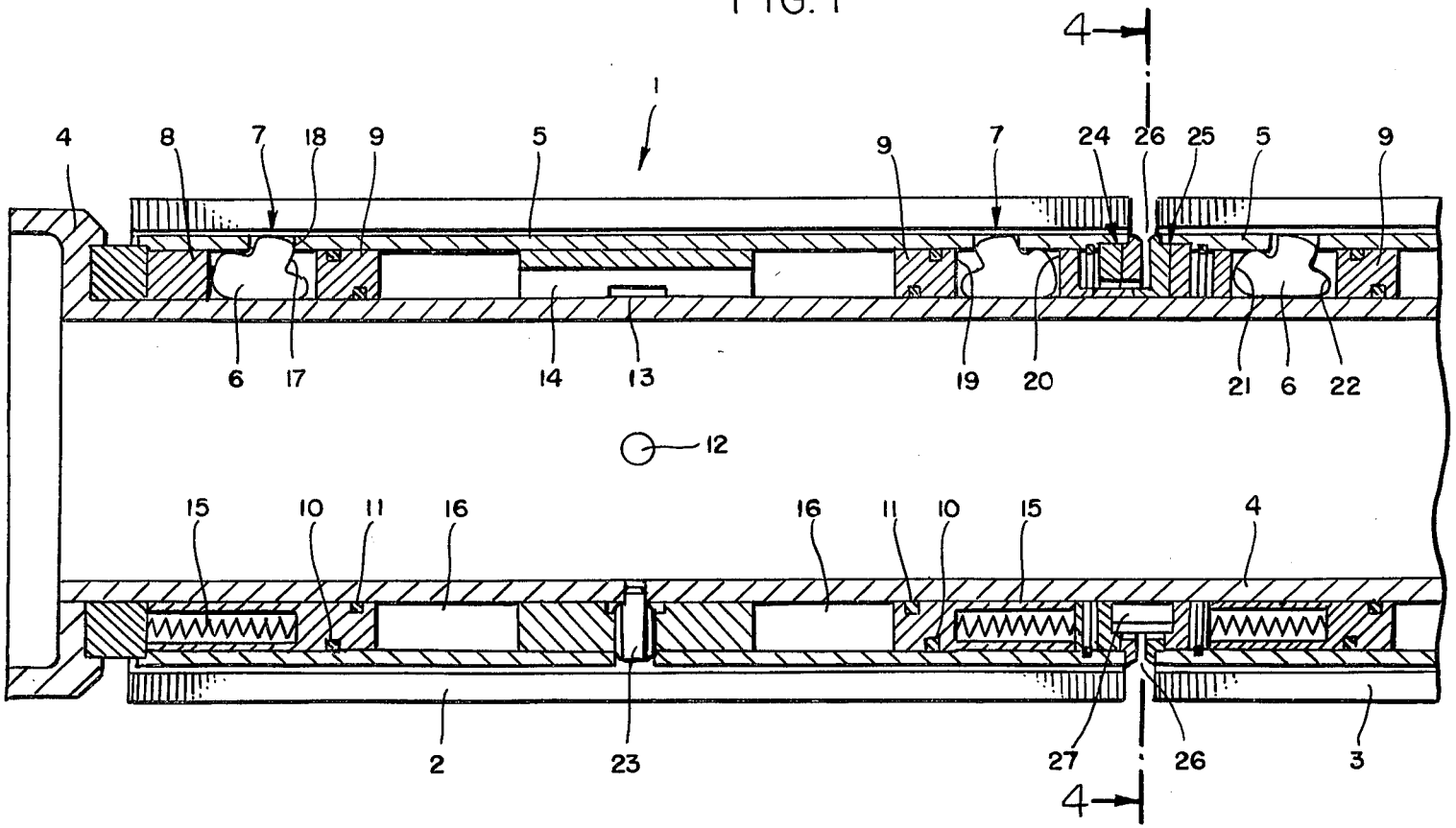
FIG. 1 is a partial longitudinal section taken on line 1—1 of FIG. 4, of a clamping chuck for the reception of multiple coaxially mounted bobbin tubes and equipped with thread catching, gripping and severing means according to the invention.
Figure 4:
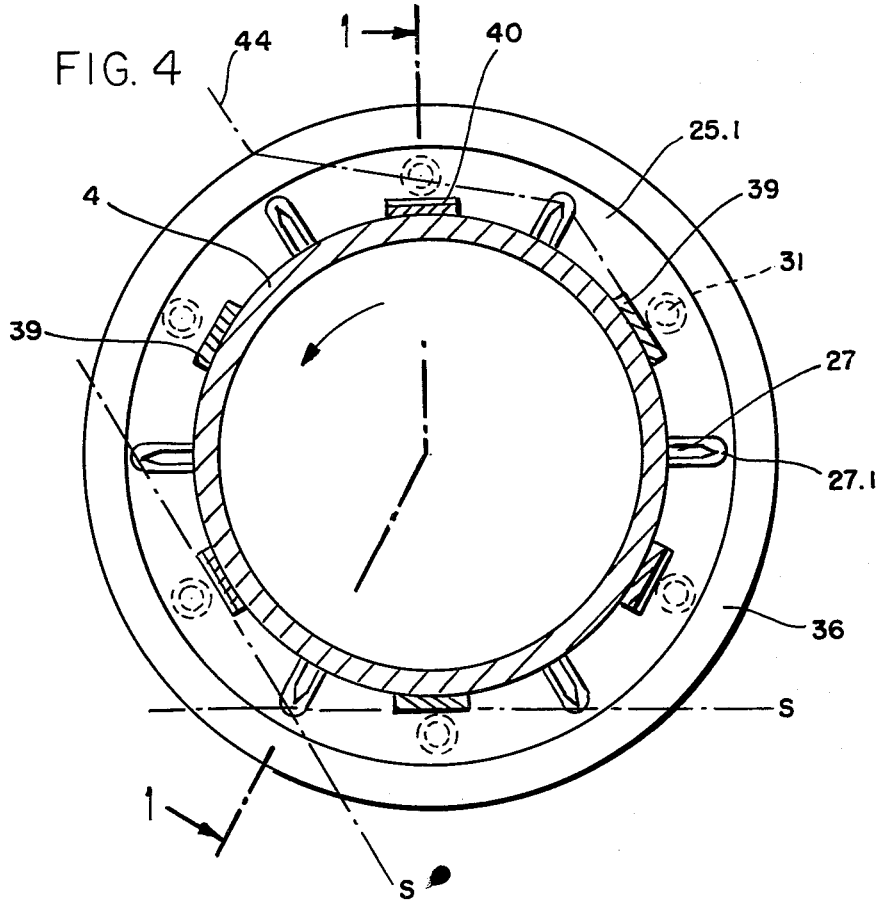
FIG. 4 is a cross-sectional view of the clamping chuck taken on line 4—4 of FIG. 1 in the region of the separating point between the two bobbin tubes.

In FIG. 1, there is shown in detail a preferred embodiment of a clamping chuck 1 for a number of bobbin tubes 2, 3 which are loadable coaxially on the same spindle as seen in a longitudinal section taken on line 1—1 of FIG. 4. Such a clamping chuck is used, for example, in winding machines adapted to wind one or several synthetic fiber threads on suitable bobbin tubes. Such winding machines are ordinarily equipped with a large number of winding units arranged along the longitudinal face of the machine frame, e.g. so as to receive a corresponding large number of freshly spun filaments, threads or yarns from a spinning apparatus.

It will be helpful in reviewing the winding operation to refer first to FIG. 6 which shows a typical winding device having a bobbin revolver with two chucking spindles rotably mounted thereon, each spindle being equipped with a bobbin clamping chuck according to FIG. 1 for the reception of one bobbin tube. Such a winding device and also those winding devices having chucking spindles with a plurality of at least two clamping chucks for the reception of a corresponding plurality of bobbin tubes are described in detail, for example, in U.S. Pat. Nos. 4,014,476 and 4,002,307 mentioned above, and it will be desirable to refer to these patents when necessary, i.e. especially with respect to the thread path and the thread changeover, so that this subject matter is included as part of the following description of the present invention.

Again with reference to FIG. 6, there is generally shown the essential parts of a spooling or winding unit of the type on which the special apparatus or improvements of the invention can be readily used. The winding device here consists of a machine casing or housing 45 connected with or made part of the machine frame and the sliding carriage 46 which is vertically movable in the guideways 47. The sliding carriage 46 carries a traversing thread guide 48 as well as a friction roller 49 which is driven by a synchronous motor (not shown). The traversing thread guide 48 reciprocates in a straight guide slot 50, being driven by a conventional reverse-spiral cam roller (not shown but see U.S. Pat. No. 4,230,285), this cam roller being mounted on the carriage 46 in a position axially parallel to the friction roller 49.

The friction roller 49 in this case is a drive roller provided with an endless thread guide groove 51, by which the thread 44 can be traversed during the acceleration of the empty bobbin tube 52.2 up to the requisite peripheral velocity of the friction roller 49 and also during the thread changeover operation. This thread guide groove 51 also avoids any jamming or squeezing-in of the thread between the friction roller 49 and the empty bobbin tube 52.2 during these operations. The thread guide groove 51 of the friction drive roller 49 also cooperates as a revolving thread guide with the reciprocating or traversing thread guide 48 in such a way that the thread is positively guided in the thread guide groove and that the desired angle of thread application onto the cross-wound bobbin is achieved.

For the secure mounting of the bobbin tubes 52.1, 52.2 it is desirable to use clamping chucks of the type which are arranged on the cantilevered bobbin spindles or shafts 4. Bobbin spindles with bobbin clamping chucks can be mounted rotatably on a bobbin revolver 53 which in itself is turnable in the housing recess or opening 54. The clamping chucks can be driven during the entire winding process by a motor which drives directly over the bobbin spindle or by an auxiliary motor as a direct drive operating only during the acceleration phase. In the second case, the main drive during winding occurs by circumferential contact of the bobbin with a drive roller. It is also possible for supporting spindles to be mounted in a non-rotatable manner while being cantilevered from the bobbin revolver, in which case the bobbin clamping chucks are carried in a freely rotatable manner on the supporting spindles while being circumferentially driven by a friction drive roller.

The empty tube 52.2 has a thread-catching notch 38 and is shown in FIG. 6 just before beginning the thread changeover. Thus, in the operating position of the bobbin revolver 53 as represented in FIG. 6, the drive roller 49 is still in surface contact with an almost finished bobbin package 55 on tube 52.1 from which the thread running in from the stationary thread guide 56 is to be transferred without loss to the empty bobbin tube 52.2 which is just ready to be wound. The empty tube 52.2 in this operating phase of the bobbin revolver is likewise driven on its surface and is initially accelerated up to the peripheral operating speed of the friction roller 49. The insertion or application of the thread 44 takes place by means of the thread changeover mechanism 57, which consists of the piston-cylinder unit 58, the auxiliary thread guide 59 and the rigid mandrel 60. Since the functioning of these individual parts and their interaction is not relevant to an understanding of the improved apparatus of the present invention, a detailed description is not required here. The thread changeover process is fully described in U.S. Pat. No. 4,002,307.

The preferred clamping chuck 1 illustrated in FIG. 1 can be rotatably mounted with its chucking spindle shaft 4 arranged, for example, on a bobbin spindle which is a part of the winding unit shown in FIG. 6.

For the general principle of construction of the clamping chuck 1, reference is made especially to U.S. Pat. No. 4,223,849 from which it will be noted that each clamping place or position is formed by a clamping element 6 inserted in the annular interspace formed between the spindle shaft 4 and the concentric mantle or shell 5. In this interspace between the spindle shaft 4 and the mantle 5, there is also arranged an annular piston ring 9 formed as a cage 8, which is radially sealed by means of sealing rings 10, 11 on both the inside and the outside with reference to the spindle shaft 4 and the mantle 5. Thus, the spindle shaft 4, the mantle 5 and the annular piston ring 9 cooperate to form a piston-cylinder unit which can be acted upon with a fluid under pressure, especially compressed air from a compressed air main connected over an axial channel (not shown) running into the spindle shaft 4, through the radial bores 12, the annular grooves 13 and the axial distributor channels 14. In each case the pistons 9, which are arranged symmetrically to the annular groove 13 and the distributor channel 14, are moved axially against the resilient force of the circumferentially distributed springs 15 in order to release the clamping elements 6, as shown in FIG. 1. When the compressed air is switched off, e.g. accompanied by the release or ventilation of the cylinders 16, the annular piston rings 9 are pushed back by the bias or stored force of the springs 15 into their initial clamping positions, in which process the clamping elements 6 are essentially moved radially outwardly to firmly clamp and hold the bobbin tubes 2, 3. Here, the convexly curved slide surfaces 17 of the clamping elements 6 are guided on the corresponding slide edges 18 of the recesses in the mantle 5.

In the movement of the clamping elements 6 in the space between the chucking spindle shaft 4 and mantle 5, the axially limiting surfaces 19, 20 of the cage 8 function as thrust or push elements which for the clamping action of the bobbin tubes 2, 3 engage on the thrust ends or large cam lugs 21 and, respectively, for the release of the bobbin tubes on the smaller cam lugs 22 of the clamping elements 6.

By means of this just described construction and arrangement of the bobbin tube clamping elements, one can ensure that in the event of a failure or malfunction of the compressed air generator or in the event of an electrical current failure, the bobbin tubes 2, 3 remain firmly clamped on the chucking spindle shaft 4 and cannot be automatically loosened in an undesired manner during high speed rotation. This advantage is already provided in accordance with U.S. Pat. No. 4,223,849.

Between two axially adjacent sections of mantle 5, secured by threaded pins 23 to the spindle shaft 4, there are arranged the thread gripping means of the present invention constructed as the catch rings 24, 25. In the released or passive state represented in FIG. 1, one can observe a defined annular gap or slit opening 26 which appears above the axis of rotation of the clamping chuck 1 and is located between the facing surfaces of the catch rings 24, 25. Since the longitudinal section of FIG. 1 is taken on line 1—1 of FIG. 4 to better illustrate the different elements, one of the circumferentially distributed cutting or severing blades 27 can be viewed in a position underneath the axis of rotation of the clamping chuck 1 and in the zone of the gap space between the two bobbin tubes 2, 3. Each blade 27 has an axially aligned cutting edge 27.1, which recedes or extends behind the outer circumference or shell surface of the mantle 5 of clamping chuck 1. As seen from FIG. 4, the blade cutting edges 27.1 lie on secants S with respect to the catch rings 24, 25. Each secant S extending between two adjacent cutting edges 27.1 should remain free of contact with the chuck shaft 4 and, at most, may be positioned approximately in almost tangential contact with the shaft 4 or the nose members 39 lying on this shaft.

Figure 2:
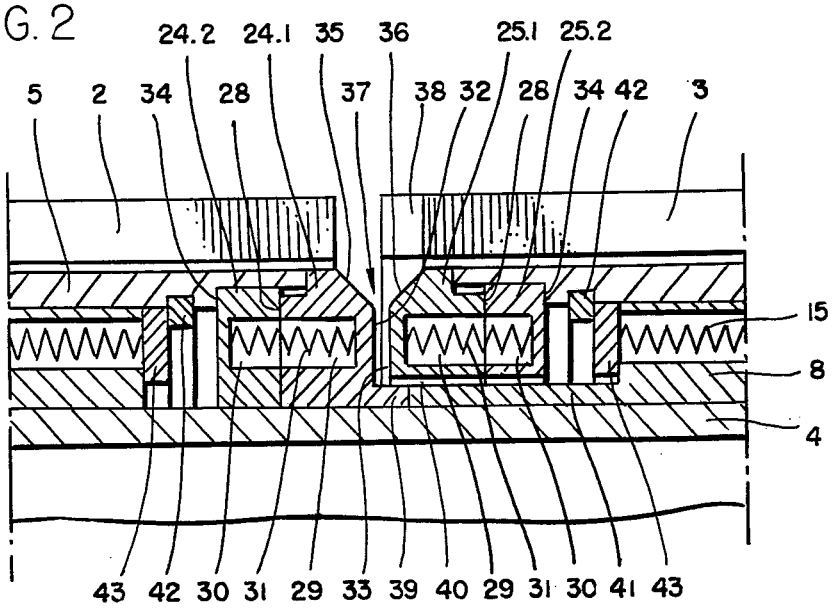
FIG. 2 is a sectional view of a cut-out portion, slightly enlarged, taken from the clamping chuck according to FIG. 1 in the region of the separating point between two bobbin tubes, showing the catch rings in a relaxed or open position so as to free the thread end.
Figure 3:
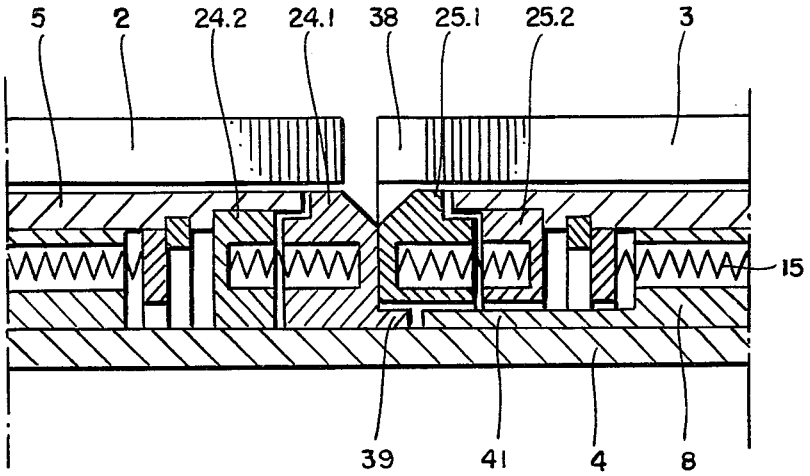
FIG. 3 is a sectional view corresponding to the cut-out portion of FIG. 2, placed under a resilient spring pressure for gripping the thread.

The detail of the separating place between the bobbin tubes 2, 3 with the installed catch rings 24, 25 are shown in FIGS. 2 and 3 on an enlarged scale. Here, FIG. 2 exhibits the catch rings in their relaxed or released state, and FIG. 3 exhibits them in their tensioned or gripping state. The catch rings 24 and 25 are closed off along their outer diameter with the mantle 5 of the clamping chuck 1 and have an inner diameter such that they are easily slidable on the spindle shaft 4. In axial direction, can ring is constructed in two parts or halves, i.e. as paired annular rings, so as to be provided in each case with a circular parting line 28. Both parts have blind-hole bores 29, 30 distributed regularly around the circumference and aligned with one another, in which there are installed the helical compression springs 31. These springs become active in the gripping direction of the catch rings 24, 25 upon relaxation or release of the piston-cylinder unit formed by the spindle shaft 4, the mantle 5 and the annular piston 9 (note FIG. 1). Thus, the springs normally press the oppositely lying face end surfaces 32, 33 of the movable parts 24.1 and 25.1 of the catch rings against one another by the sum of the forces provided by all of the helical springs 31. The stationary parts 24.2 and 25.2 of the catch rings simultaneously provide a counterbearing or resisting force, since they are constructively fixed by a shoulder 34 in the mantle 5 against any axial displacement.

The axially extending and opposing outer parts 24.1 and 25.1 of the catch rings are preferably formed on their outer circular edges 35, 36 with a bevel of 30° to 60°, so that the catch rings 24, 25 when pressed together provide a V-shaped thread catching groove 37 around their circumference. Thereby, the thread 44 when caught on the thread catching notch 38 of the bobbin tube 2,3 slips along these inclined surfaces so as to be drawn into the holding or gripping slit 26. The rear or axially inner edge of the movable parts 24.1, 25.1 of the catch rings abuts on the face surfaces of the mantle 5 and, if need be, on the face surfaces of the fixed parts 24.2, 25.2 of the catch rings.

The opposing front face surfaces 32, 33 of the movable catch rings 24.1, 25.1 are provided with circumferentially distributed nose members 39 and also the circumferentially distributed axial guide grooves 40, these nose members 39 and guide grooves 40 being spaced equidistantly and alternately around the fixed parts 24.2, 25.2 of the catch rings. Through these guide grooves 40, there extend axial projections or fingers 41 which are fastened rigidly to the cages 8 of the piston-cylinder units (i.e. to the annular pistons 9) in a corresponding circumferential distribution. In this manner, it is possible to avoid on the one hand a relative rotation between the cages 8 and the two matching parts of each of the catch rings 24.1, 24.2 and 25.1, 25.2, respectively, so that a shearing stress on the helical springs 31 will not occur. On the other hand, by means of pressure on the oppositely situated nose members 39 during the actuation of the piston-cylinder units and also during the resulting axial movement of the annular pistons 9, the movable parts 24.1, 25.1 of the catch rings force back and compress the helical springs 31 while the thread gripping gap 26 is automatically opened to free the thread end during the release and doffing or withdrawal of the bobbin tubes 2, 3. With this positive release of the thread gripping means, no thread residues or tangled thread ends can remain stuck to the clamping chuck 1.

The helical springs 15, which after ventilation of the cylinders 16 force the annular pistons 9 into their original position and actuate the clamping elements 6 for the bobbin tubes 2, 3 in their clamping direction, can be supported on a counterbearing or retaining ring 43 secured by a suitable snap ring 42.

FIG. 3 illustrates the same embodiment of FIG. 2 to show the catch rings 24, 25 of the clamping chuck 1 in their ready-for-winding state, in which the opposing end face surfaces of the catch rings 24, 25 are pressed resiliently against one another by the spring force and the annular pistons 9 are forced back into their pressure-free starting position by the force of the helical springs 15.

FIG. 4, as a cross section taken on line 4—4 of FIG. 1, shows the distribution of the thread-severing blades 27 on the circumference of the clamping chuck. The axial finger-like projections 41 are arranged in alternating positions with respect to the blades 27 and are mounted on the annular piston 9 in order to shift the movable part 24.1 of the catch ring or, more specifically, the circumferentially distributed nose members 39 on the oppositely lying, movable part 24.1 of the catch ring.

During the thread transfer or changeover, a thread 44 (FIG. 4) is first caught on the thread-catching notch 38 of the bobbin tube 2 or 3, and then on the tube inner edge as the clamping chuck turns in the direction shown by the arrow. The thread 44 is thus deflected and is drawn into the gripping gap or split 26, due to the pulling force being exerted on the thread, where it then strikes against one of the cutting edges 27.1 of a severing blade 27 and is cut or lopped off. The thread piece or trailing end running to the full bobbin is drawn out from the gripping gap 26 and runs over the thread catching eye of the auxiliary thread guide (shown only in FIGS. 2–4 of U.S. Pat. No. 4,002,307) onto the almost full bobbin and is wound thereon to complete this bobbin package. The other thread piece remains gripped in the gap or slit 26 and rises over the thread-catching notch 38 onto the circumference of the empty bobbin tube where at first there is wound a thread reserve for tie-on purposes, and the thread 44 is then grasped by the traversing thread guide and wound back and forth along the intended winding length of the bobbin. After completion of the bobbin and before the next bobbin change, the clamping chuck 1 is braked and actuated with compressed air in order to release the clamping of the bobbin tubes 2, 3. Simultaneously, as described above, through the excursion or pressure-actuated axial movement of the annular pistons 9, the thread gripping slit 26 is opened and the beginning part or initial run-on of the thread, which is no longer held, can be withdrawn with the full bobbin onto a receiving spindle of a doffer or the like. It may be further noted that in the operation of the winding device with several bobbin tubes arranged successively on the same chucking spindle, the spacing between the individual tubes can be maintained in various ways, either through the use of spacing lugs mentioned at the outset or by corresponding spacing means arranged on the clamping chuck itself. With the catch rings of the present invention, however, a machine-fixed spacer handle is preferably combined as part of the winding unit, this handle having several fingerlike grippers or claws. During the slipping-on or loading of the empty tubes onto the clamping chuck, the spacer handle is swung about a pivot axis axially parallel to the clamping chuck such that the grippers or claws establish and define with corresponding tube engagement the required spacing between the bobbin tubes. Preferably, in swinging back the spacer handle, a valve can be automatically actuated by an end switch in such a manner that the valve blocks the compressed air feed and the bobbin tubes are automatically clamped. In this manner, it is possible for the operating personnel to carry out a very simple bobbin change without any need to manually operate or service the clamping chuck itself or to spend undue time and effort to keep the chuck under observation or to remove adhered thread ends.

In the preferred winding device of FIGS. 1, 2 and 3, the two catch rings 24 and 25 are divided in half and the two parts 24.1 and 25.1 of these catch rings are constructed so as to be axially movable. It is also just as useful, however, to provide a thread catching and gripping arrangement in which only one of the catch rings has an axially movable part, for example 24.1, and in which the rings 25.1 and 25.2 form a one-piece thread gripping ring which is rigidly joined with the mantle 5. In this case, of course, no bores 29 and 30 are present and no springs 31 are required. Only the right-hand cage 8 in the drawing will have axial projections which pass through guide grooves 40 in the catch ring 25 for the freeing of the thread to actuate and shift the movable part 24.1 against the force of the spring 31 toward the axially stationary part 24.2.

This just described arrangement, which has not been illustrated, resembles the construction shown in FIG. 5, with a thread-catching and gripping arrangement on one end of the bobbin chucking spindle, i.e. rather than at the separating place or spaced gap between two bobbin tubes. On the left-hand end of the bobbin chucking spindle 4 shown in FIG. 5, there is present a shoulder 61, over which there is engaged the axially movable catch ring 62. Several blind-hole bores 63 and 64, circumferentially distributed in this shoulder 61 and in the catch ring 62, receive the compression springs 65. A one-piece catch ring is fastened to the mantle 5 by means of a threaded pin 66. By means of several grooves 40 axially distributed around the circumference in the catch ring 25, there are engaged the projections or fingers 41 which are fastened to the cage 8 and the piston ring 9, respectively.

The compression springs 65 press the axially movable catch ring 62 toward the axially immovable catch ring 25. The catch rings 25 and 62 thus form between them a gripping slit or gap 26. As already described in connection with FIGS. 1 to 3, in order to free the thread end caught between the catch rings 25 and 62, the annular piston 9 is actuated with compressed air, whereby the cage with its projections 41—according to the representation given in FIG. 5—shifts the catch ring 62 to the left against the force of the springs 65. In this process, the associated clamping chuck is also released.

The thread catching and gripping device, when constructed in this manner according to the invention, can be arranged both on the machine-side end and also on the free end of the bobbin chucking spindle.

We claim:

1. A winding device for winding threads on one or more bobbin tubes releasably held on a bobbin clamping chuck having a rotatably mounted chuck spindle shaft, said device including at the end position of each tube to be held on the chuck:

thread catching and gripping means for each tube to pick up and retain the thread being led onto the tube, said means comprising (a) a pair of catch rings constructed with opposing annular faces mounted around the chuck spindle shaft and having an outer diameter smaller than the tube inner diameter, at least one of said catch rings being axially movable on the chuck spindle shaft of the clamping chuck to form an adjustable slit between said annular faces, and (b) force transmitting means to press said catch rings against each other in order to close said slit and grip the thread between said opposing annular faces; and thread severing means for cutting the thread after it is caught and gripped, said means comprising radial cutting blades having essentially axially arranged cutting edges, said blades being affixed to the chuck spindle shaft at circumferentially distributed positions around the chuck in the area of said slit, and the cutting edges of adjacent cutting blades lying on secants of the catch rings with the line of each secant being at most approximately tangential to the chuuck spindle shaft.

2. A winding device as claimed in claim 1, wherein for a loss-free winding of continuous synthetic fiber threads from a spinning machine onto bobbin tubes, at least two chuck spindle shafts are rotatably mounted on a turnable bobbin revolver.

3. A winding device as claimed in claim 1, wherein the chuck spindle shaft has a plurality of chuck clamping zones in axial succession for receiving a corresponding plurality of bobbin tubes, a pair of said catch rings and their related severing blades being arranged between each two neighboring chuck clamping zones.

4. A winding device according to claim 3 wherein a mantle of smaller diameter than the bobbin tube is mounted between adjacent pairs of catch rings, said mantle being concentric to the chuck spindle shaft to form an annular interspace therewith, and said mantle having radial recesses for the radial movement of circumferentially distributed clamping elements outwardly to clamp each bobbin tube and inwardly to release each tube.

5. A winding device as claimed in claim 1 or 4, wherein the bobbin tube has a thread catching notch on its end surface adjacent the catch rings.

6. A winding device as claimed in claim 1, wherein said force transmitting means includes resilient spring means to press the paired catch rings against each other for catching and gripping the thread and also includes piston-cylinder means to pneumatically press the catch rings apart from each other for freeing the thread.

7. A winding device as claimed in claim 6 wherein said piston-cylinder means is operatively connected to release the clamping chuck simultaneously with the pressing apart of the catch rings to free the thread.

8. A winding device as claimed in claim 4 wherein said clamping elements are arranged in cages with thrust means and counteracting force transmitting means to axially move said cages in the annular interspace between the rotatable chuck spindle shaft and the mantle in order to clamp and release the bobbin tubes, respectively, and the catch rings are mechanically coupled with each cage so that the axial movement of the cage to release the bobbin tubes also effects the pressing apart of the catch rings to release the thread.

9. A winding device as claimed in claim 8 wherein each cage has at least one axial projection which slidingly penetrates an adjacent catch ring through a guide slot therein and axially moves the associated catch ring, which is paired therewith and which lies axially therebeyond, against the force of a spring so that the gripping slit is opened to release the thread from between the paired catch rings.

10. A winding device as claimed in claim 8 wherein at least one catch ring of each pair consists of two separate parts, one of which is fixed and the other adjacent part is arranged to be axially movable on the chuck spindle shaft.

11. A winding device as claimed in one of claims 8 or 9 wherein both catch rings of each pair are axially movable, at least one movable part of the catch ring under a first bobbin tube cooperates with a projection of the cage under a second adjacent bobbin tube and, conversely, at least one movable part of the catch ring under the second bobbin tube cooperates with a projection of the cage under the first bobbin tube, whereby each projection transmits an axial force applied to said cages.

12. A winding device as claimed in claim 1 wherein axially opposed annular edges of the catch rings adjacent said opposed annular gripping faces are inclined in such a manner that the paired catch rings commonly define a circumferential V-shaped thread receiving groove.

* * * * *